US010473428B2

(12) United States Patent
Tedder et al.

(10) Patent No.: US 10,473,428 B2
(45) Date of Patent: Nov. 12, 2019

(54) ANKLE HOLSTER

(71) Applicant: Tedder Industries, LLC, Post Falls, ID (US)

(72) Inventors: Thomas Tedder, Post Falls, ID (US); Taylor Vold, Valleyford, WA (US); Nathan Eshleman, Sandpoint, ID (US)

( * ) Notice: Subject to any disclaimer, the term of this patent is extended or adjusted under 35 U.S.C. 154(b) by 3 days.

(21) Appl. No.: 15/871,578

(22) Filed: Jan. 15, 2018

(65) Prior Publication Data

US 2018/0202765 A1 Jul. 19, 2018

Related U.S. Application Data

(60) Provisional application No. 62/445,748, filed on Jan. 13, 2017.

(51) Int. Cl.
*F41C 33/04* (2006.01)
*A45F 5/00* (2006.01)

(52) U.S. Cl.
CPC ..... *F41C 33/048* (2013.01); *A45F 5/00* (2013.01); *F41C 33/043* (2013.01); *F41C 33/046* (2013.01); *A45F 2005/008* (2013.01); *A45F 2200/0591* (2013.01)

(58) Field of Classification Search
CPC ..... A45F 5/00; A45F 2005/008; A45F 2200/0591; F41C 33/043; F41C 33/048; F41C 33/046; F41C 33/0209; F41C 33/04; F41C 33/041; F41C 33/0245; F41C 33/0236
USPC ..... 224/587, 911, 243, 912
See application file for complete search history.

(56) References Cited

U.S. PATENT DOCUMENTS 6,149,042 A * 11/2000 Rassias ..... A45F 5/00 224/661
6,176,402 B1 * 1/2001 Rogers ..... A45C 1/04 224/222
8,215,525 B2 * 7/2012 Rassias ..... F41C 33/0236 224/192
2013/0001264 A1 * 1/2013 Popovici ..... F41H 1/02 224/222
2015/0108191 A1 * 4/2015 Velarde ..... F41C 33/046 224/576
2016/0025451 A1 * 1/2016 Morgan ..... F41C 33/0272 224/198

* cited by examiner

*Primary Examiner* — Nathan J Newhouse
*Assistant Examiner* — Matthew T Theis
(74) *Attorney, Agent, or Firm* — Timberline Patent Law Group

(57) ABSTRACT

Representative implementations of devices and techniques provide a ankle holster assembly to mount and to support an implement (such as a handgun, for example) or an implement holster (such as a handgun holster, for example), or the like, in a variety of configurations. The ankle holster assembly includes a base having a receiver and a post having a shaft, the shaft arranged to be inserted into the receiver to removably couple the post to the base.

16 Claims, 15 Drawing Sheets

ANKLE HOLSTER

PRIORITY CLAIM AND CROSS-REFERENCE TO RELATED APPLICATION

This application claims the benefit under 35 U.S.C. § 119(e)(1) of U.S. Provisional Application No. 62/445,748, filed Jan. 13, 2017, which is hereby incorporated by reference in its entirety.

BACKGROUND

Implements, such as tools, weapons, and the like, may be temporarily encased in a carrier (such as a holster, for instance) for protection of the implement and/or the user, while providing access to the implement. For example, a carrier may allow a user to conveniently carry the implement, safely retaining the implement until needed. When the implement is to be used, the user may withdraw the implement from the carrier, and then return it to the carrier when finished. In some cases, such as with a handgun for example, the holster may allow the user to conceal the implement, or to conceal the fact that the user is carrying the implement.

In the case of a handgun, the holster should reasonably protect the handgun and the user, and should be convenient to the user for ready use. Accordingly, the holster should retain the handgun until it is to be used, but allow the user to draw the handgun for use without undue effort or difficulty. The holster should be rigid and stable enough to allow the handgun to be repeatedly drawn and re-holstered, usually with the same hand. However, the holster should also be versatile enough to be comfortably carried by the user, such as when it is worn on the person of the user for an extended length of time.

In many circumstances it can be desirable to have more than one holster configuration for a handgun or other implement. For example, at different times it may be desirable to have one holster configured for outside-the-waistband (OWB) carry, another holster configured for inside-the-waistband (IWB) carry, still another holster for shoulder carry, an additional holster for ankle carry, and so forth, often for the same handgun. The desire for multiple holster configurations can be further compounded for multiple handguns (or implements).

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

For this discussion, the devices and systems illustrated in the figures are shown as having a multiplicity of components. Various implementations of devices and/or systems, as described herein, may include fewer components and remain within the scope of the disclosure. Alternately, other implementations of devices and/or systems may include additional components, or various combinations of the described components, and remain within the scope of the disclosure. Shapes and/or dimensions shown in the illustrations of the figures are for example, and other shapes and or dimensions may be used and remain within the scope of the disclosure, unless specified otherwise.

DETAILED DESCRIPTION

Figure 1:
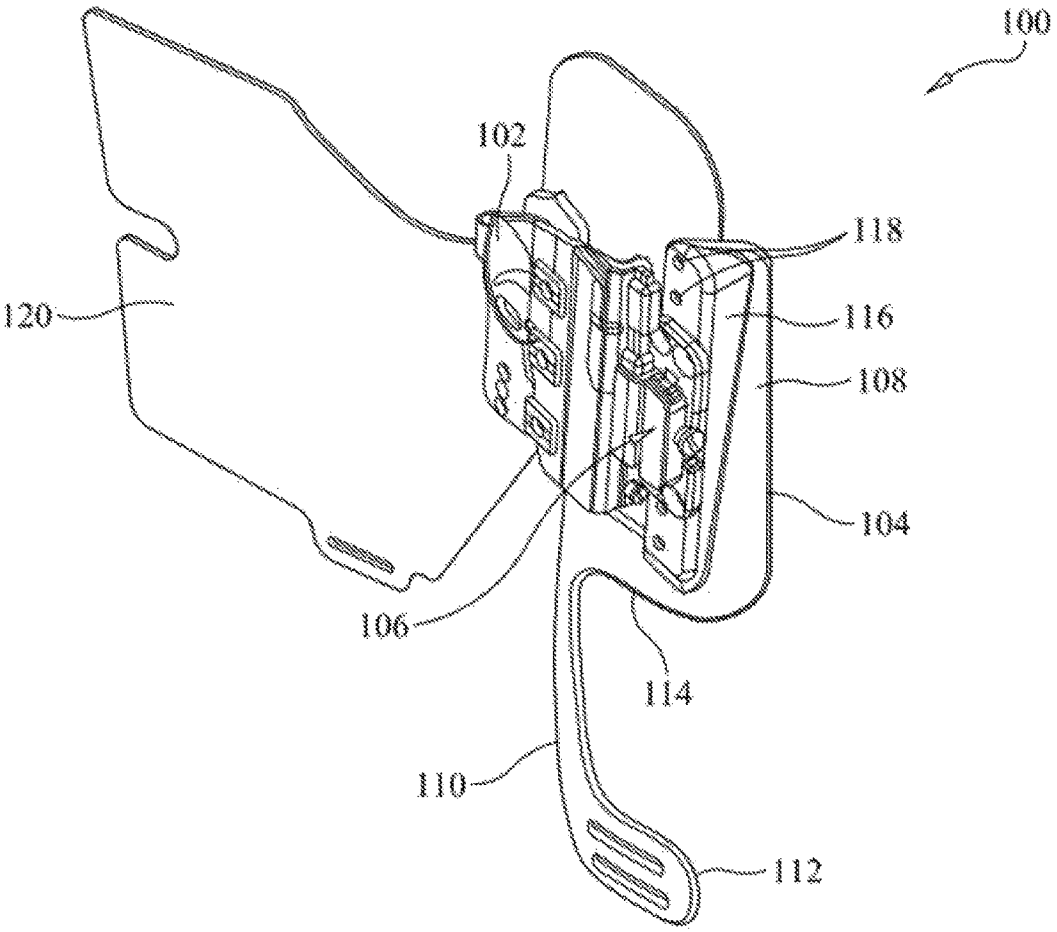
FIG. 1 shows a perspective view of an example ankle holster assembly, according to an embodiment.

Representative implementations of devices and techniques provide an ankle holster assembly to mount and to support an implement (such as a handgun, for example) or an implement holster (such as a handgun holster, for example), or the like, in a variety of configurations. The ankle holster assembly is arranged to be worn on a user's lower leg (for example) for temporarily and safely carrying the implement, while making the implement easily accessible to the user. In various examples, the ankle holster assembly can be mounted to the user's leg for carrying the implement in a concealed manner. It can also be worn on another part of a user's person, or can be used to support an implement or implement holster in another location not on a user.

In various implementations, the ankle holster can be a stand-alone unit, or it can be a part of a modular holster system. For example, in some implementations, the user can remove the implement and/or an implement holster (such as a holster shell, for example) from their person or from a storage location, including from a holster belt, from a concealed holster rig, from a shoulder holster strap, from a vehicle location, from an item of furniture, and so forth. The user can then mount the implement and/or the implement holster (or holster shell) to the ankle holster assembly for concealed carry on the user's lower leg.

Techniques and devices are discussed with reference to example handgun holsters illustrated in the figures. However, this is not intended to be limiting, and is for ease of discussion and illustrative convenience. The techniques and devices discussed may be applied to a holster or to any of various cases, carriers, containers, implements, tools, objects, and the like, and remain within the scope of the disclosure. For the purposes of this disclosure, the generic term "carrier" is used to indicate any or all of the above.

Further, the shape and quantity of the ankle holster assembly components illustrated in the figures (including the wraps, backers, braces, locking mechanisms, holster shells, etc.) may vary to accommodate the various objects to be carried, as well as to accommodate various applications. In alternate embodiments, fewer, additional, or alternate components may be used and/or combined to form an ankle holster assembly having an equivalent function and operation.

Implementations are explained in more detail below using a plurality of examples. Although various implementations and examples are discussed here and below, further implementations and examples may be possible by combining the features and elements of individual implementations and examples.

Example Ankle Holster

An example ankle holster assembly 100, and example ankle holster assembly 100 components are shown in FIGS. 1-15. In various implementations, the ankle holster assembly 100 includes a holster shell component 102 (which may be a modular component from a modular holster system). The holster shell 102 may have many configurations and forms. For instance, the holster shell 102 may be a full holster (e.g., enclosing a majority of the implement), a partial holster (e.g., enclosing half or less of the implement), a half-shell holster (e.g., intended to enclose roughly one side of the implement), a modified half-shell holster (e.g., intended to enclose roughly one side of the implement plus additional portions of the implement, such as a trigger guard), and so forth. The holster shell 102 may be formed of a rigid, semi-rigid, or mostly-flexible material.

Referring to FIGS. 1-15, in various implementations, the ankle holster assembly 100 includes a brace 104, and a connection assembly 106. For example, the holster shell 102 may be mounted to a single brace 104, as shown in FIGS. 1-15, to form the ankle holster assembly 100. The brace 104 is configured to be worn on the lower leg of the user, and adapted to support the weight of the holster shell 102 and the implement. For example, the brace 104 of the ankle holster assembly 100 is designed and shaped to support the weight of an implement (a weapon, tool, or other implement) and may be worn on the inner or outer portion of a user's leg above the ankle to distribute the weight of the implement across the lower leg and ankle for maximum comfort. This may be facilitated by wearing the brace 104 so that the lower end of the brace 104 (the lower support 108) extends to the sole of the user's shoe. Most of the weight may then be transferred to the shoe.

In various implementations, as shown in FIGS. 1-4 and 8-15, the brace 104 is comprised of an attachment arm 108 and a support arm 110. In the implementations, the attachment arm 108 includes an attachment mount 116 which includes one or more mounting features 118, such as holes, tabs, hooks, or the like, for temporarily or permanently mounting the holster shell 102 to the brace 104. The attachment mount 116 may include a plurality of mounting features 118, which may be selected from to determine an ideal mounting height for the holster shell 102. For example, the holster shell 102 may be coupled to the attachment mount 116 higher to accommodate a larger implement or lower for a smaller one. In some cases, the holster shell 102 may be coupled to the attachment mount 116 via temporary or permanent fasteners, such as screws, bolts, rivets, or other suitable fasteners.

In other embodiments, the holster shell 102 is coupled to the brace 104 via the connection assembly 106. In the embodiments, the connection assembly 106 is coupled to the attachment mount 116 using the mounting features 116. The holster shell 102 may be coupled to the brace 104 using the connection assembly 106, and removed as desired, as discussed further below.

Figures 2A, 2B, 2C:
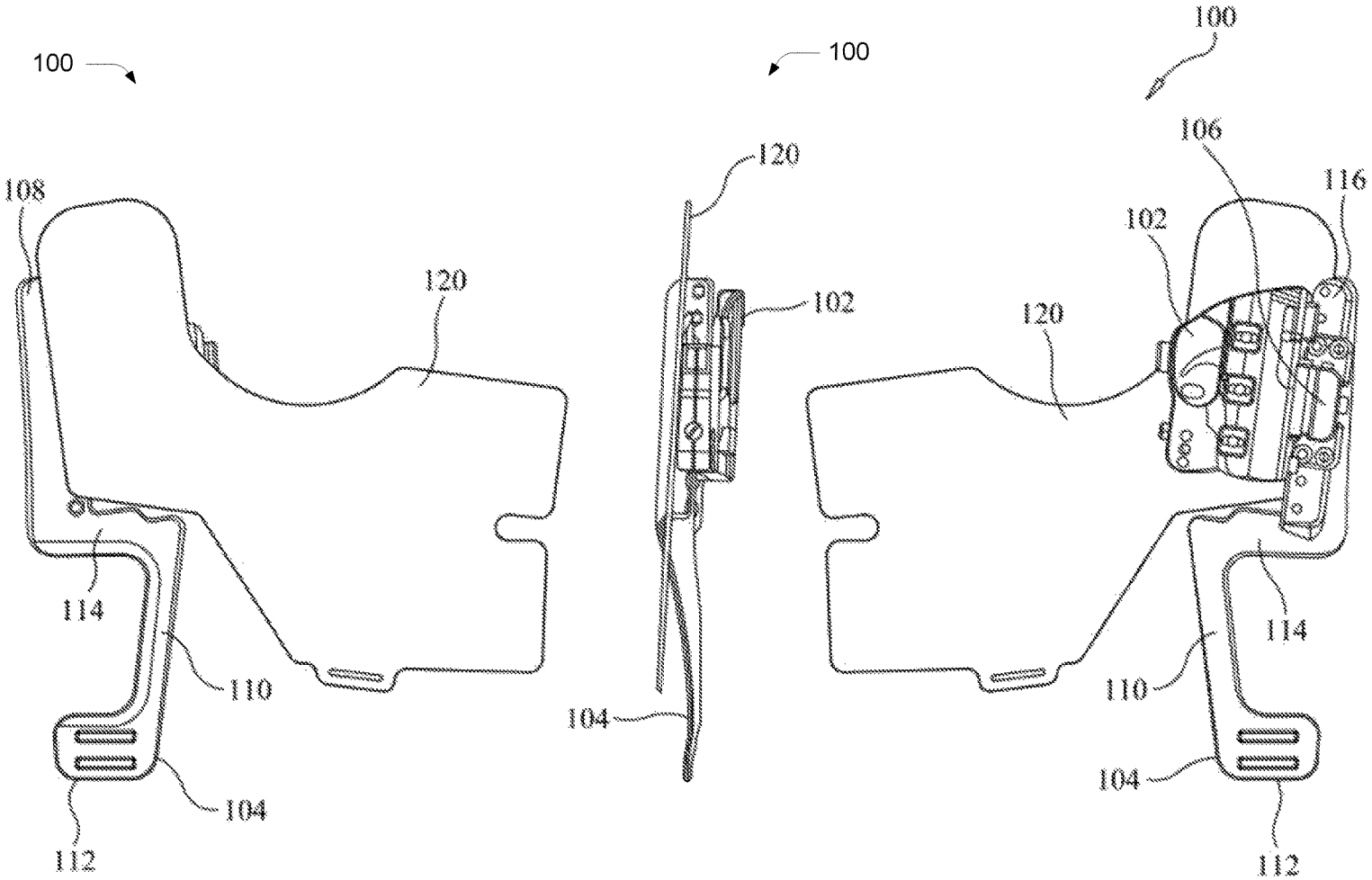
FIGS. 2A-2C show three views: (A) inside, (B) profile, and (C) outside of the example ankle holster assembly of FIG. 1, according to an implementation.
Figure 3C:
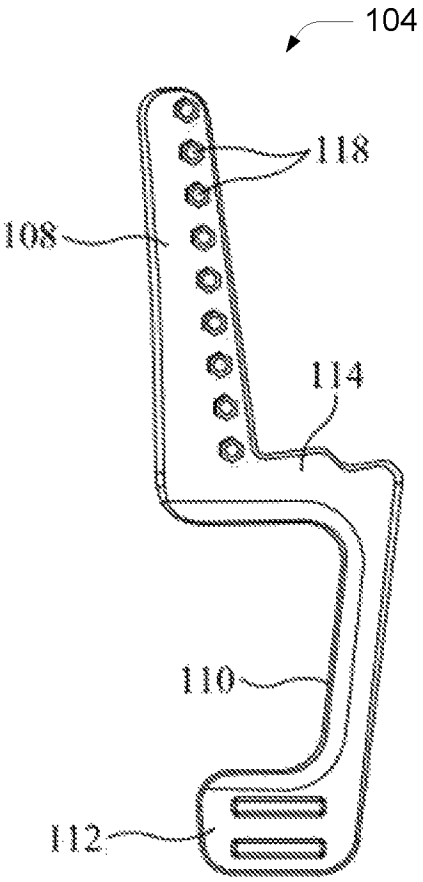
FIGS. 3A-3C show three views (A) outside, (B) profile, and (C) inside of an example ankle holster brace, according to an implementation.
Figure 3B:
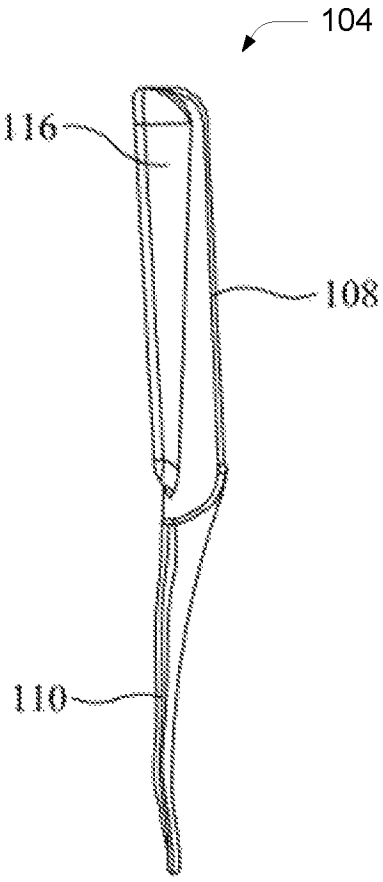
Figure 3A:
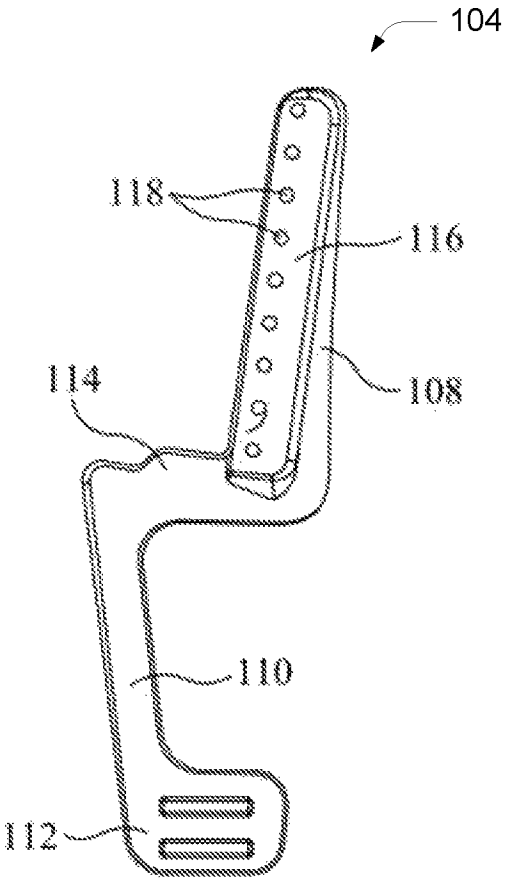
Figure 4:
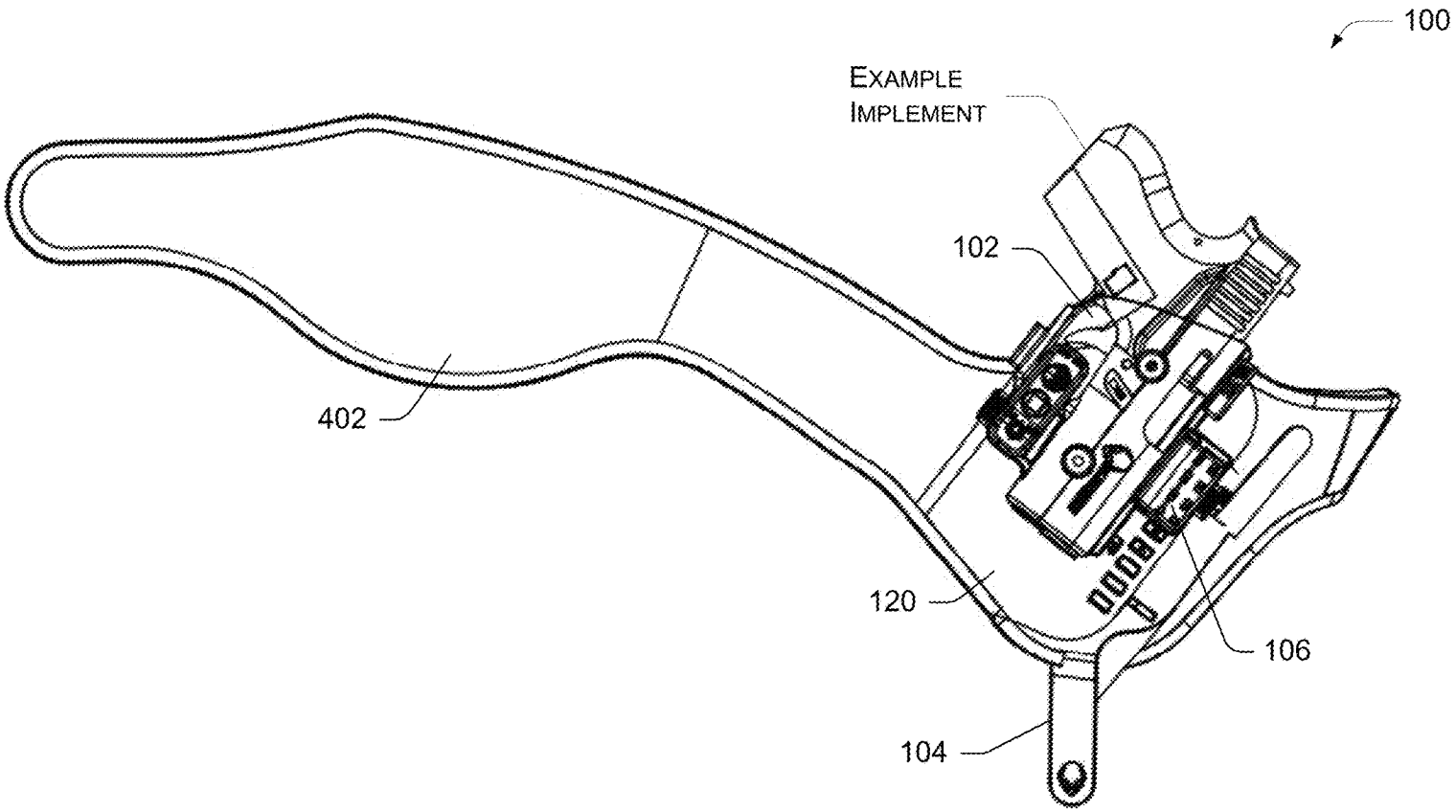
FIG. 4 shows a view of an example ankle holster assembly, according to another embodiment.

In various embodiments, as shown in FIGS. 1-4 and 8-15, the support arm 110 is arranged to support the weight of the implement and the holster shell 102, and to transfer or distribute the weight across the user's lower leg. In one example embodiment, as shown in FIGS. 1-3, the support arm 110 can also transfer the weight to a lower support 112, which can transfer the weight to the user's shoe. As also shown in FIGS. 1-3, the brace 104 may include an offset arm 114 to offset the attachment arm 108 from the support arm 110. The offset arm 114 can help to distribute the weight of the implement across the user's lower leg, as well as to transfer the weight from the attachment arm 108 to the support arm 110. In some implementations, the length of the offset arm 114 (the amount of offset) may vary, and can be determined by the size of the implement or holster to be carried. For example, the offset arm 114 may be configured to position the support arm 110 under the approximate center of gravity (or other desired location) of the implement or holster 102 to be carried.

As shown in FIGS. 1-3, the lower support 112 may be disposed at the end of the support arm 110, and can be configured to rest inside the user's shoe. The lower support 112 can include one or more openings for attaching a strap, or the like, for fastening the brace 104 to the user's leg. In an embodiment, a strap can be attached to the lower support 112 and also to another portion of the assembly 100 (e.g., a backer, a wrap, etc.) for securing the ankle holster assembly 100 to the user.

In other embodiments, the weight transfer can also be accomplished with an angled, curved, or otherwise offset support arm 110. In an embodiment, as shown in FIGS. 8-15, the support arm 110 is attached to (or integral to) the attachment arm 108 at an angle, to offset the lower end (e.g., free end) of the support arm 110 as desired for weight transfer. The angle of offset of the support arm 110 can determine the effectiveness of the weight transfer. For example, the lower free end of the support arm 110 can be positioned at the approximate center of gravity (or other desired location) of the implement and holster shell 102. In an alternate embodiment, the support arm 110 is curved to offset the lower free end of the support arm. Additionally, in various embodiments, the free end of the support arm can be positioned at or near the sole of the user's shoe to transfer the weight of the implement and holster shell 102 to the shoe of the wearer.

In various implementations, the ankle holster assembly 100 also includes a backer 120, which may be removable in some embodiments. In some examples, the holster shell 102 may be mounted to the backer 120, with the backer 120 mounted to the brace 104 to form the ankle holster assembly 100. In other examples, the backer 120 and the holster shell 102 may be coupled to the brace 104 individually. In some embodiments, the backer 120 may also be used to at least partially secure or stabilize the ankle holster assembly 100 on the leg of the user.

If included, the backer 120 can be coupled to the attachment mount 116, to the attachment arm 108 or elsewhere on the brace 104, to the holster shell 102, or otherwise. The backer 120 can provide comfort to the wearer (as a holster backer), provide protection for the implement, and/or can help to secure or stabilize the ankle holster assembly 100 on the user. In an example, as shown at FIGS. 1, 2, 4, 14, and 15 the backer 120 can at least partially wrap around the leg of the user and can be secured using straps, fasteners, or the like.

Figure 5B:
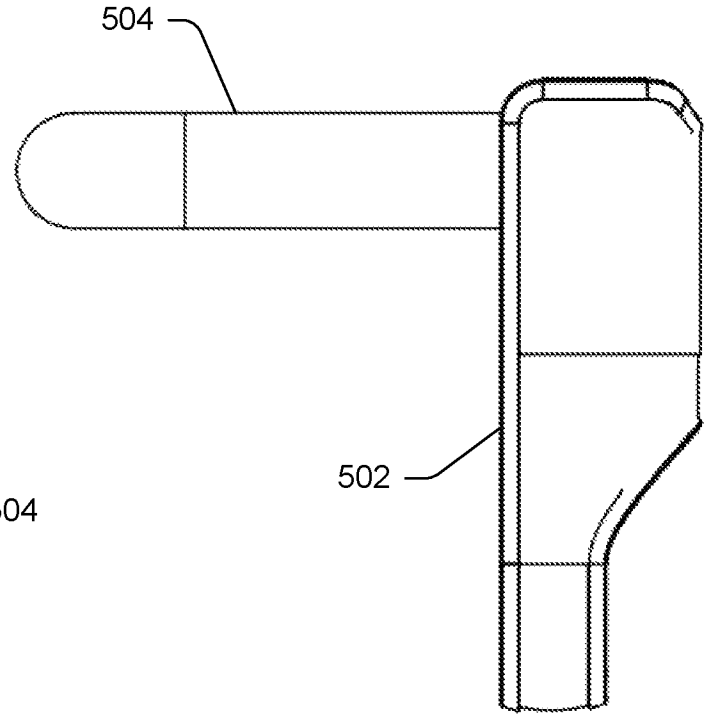
FIGS. 5A and 5B show (A) perspective view and (B) side view of an example lower wrap, according to an embodiment.
Figure 5A:
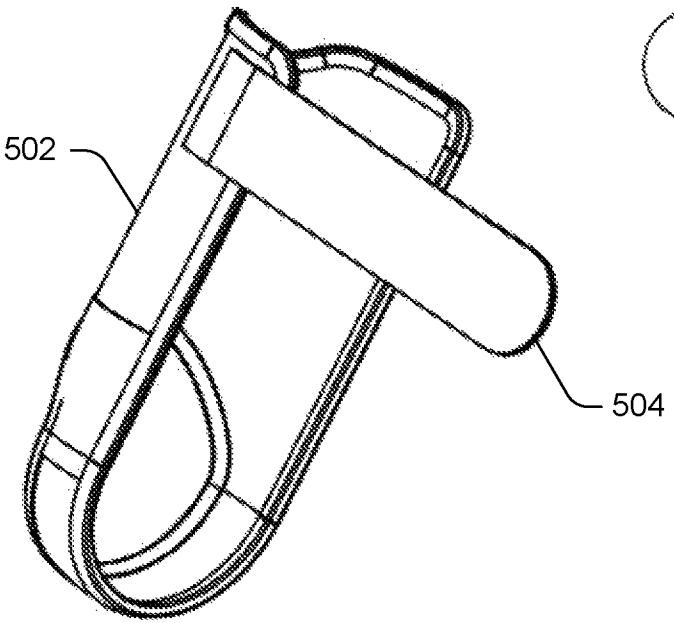
Figure 6:
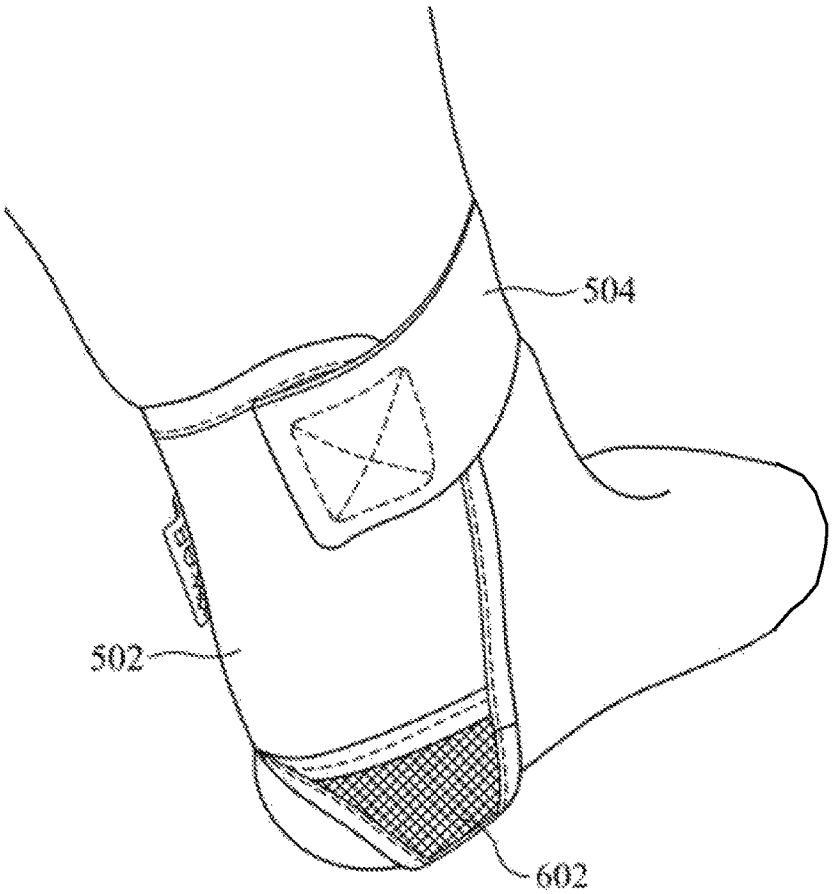
FIG. 6 shows a perspective view of the example lower wrap of claim 5, fitted to a user, according to an embodiment.
Figure 7:
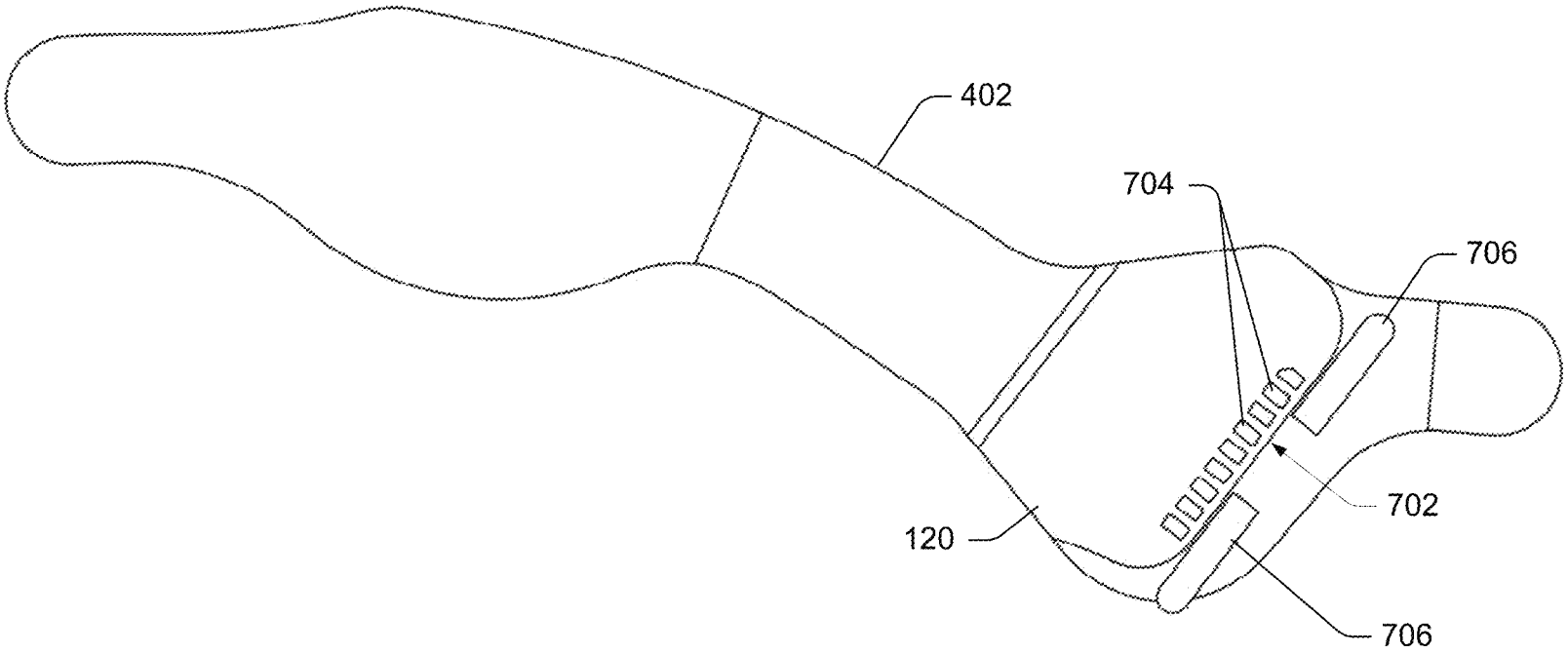
FIG. 7 shows an example upper wrap, according to an embodiment.

Referring to FIGS. 4-7, in an implementation, the ankle holster assembly 100 includes an upper wrap 402 (see FIGS. 4 and 7) and/or a lower wrap 502 (see FIGS. 5A, 5B, and 6). In an embodiment, the brace 104 is coupled to the upper wrap 402, and may also be coupled to the lower wrap 502, while the upper wrap 402 and the lower wrap 502 (if used) are wrapped around the lower leg (for example) of the user. In the embodiment, the upper wrap 402 and the lower wrap 502 (if used) stabilizes the ankle holster assembly 100 on the leg of the user, as well as providing protection to the user and to the implement. For example, in some embodiments, the upper wrap 402 wraps substantially around the ankle holster 100 as well as the user's leg, forming a protective and concealing pocket around the holster shell 102.

In an embodiment, as shown in FIGS. 4 and 7-9, the backer 120 is integral to or attached to the upper wrap 402. In one implementation, the backer 120 is attached at one or more points on the backer 120 to the upper wrap 402, forming a pocket 702 between the upper wrap 402 and the backer 120. In the implementation, the brace 104 is disposed at least partly into the pocket 702 when the brace 104 is attached to the backer 120.

Referring to FIGS. 7-11, in an implementation, the backer 120 includes one or more fixtures, such as openings 704 or the like, to interface with the brace 104. The fixtures or openings 704 are configured (sized, shaped, positioned, spaced, etc.) to interface with the mounting features 118 on the brace 104. For example, in one case, as shown in FIGS. 7-11, the mounting features 118 of the brace 104 comprise protrusions (or the like) and the mounting features 118 fit into or through the openings 704 in the backer 120 when the brace 104 is positioned into the pocket 702 (see particularly FIGS. 10A and 11).

Figure 8:
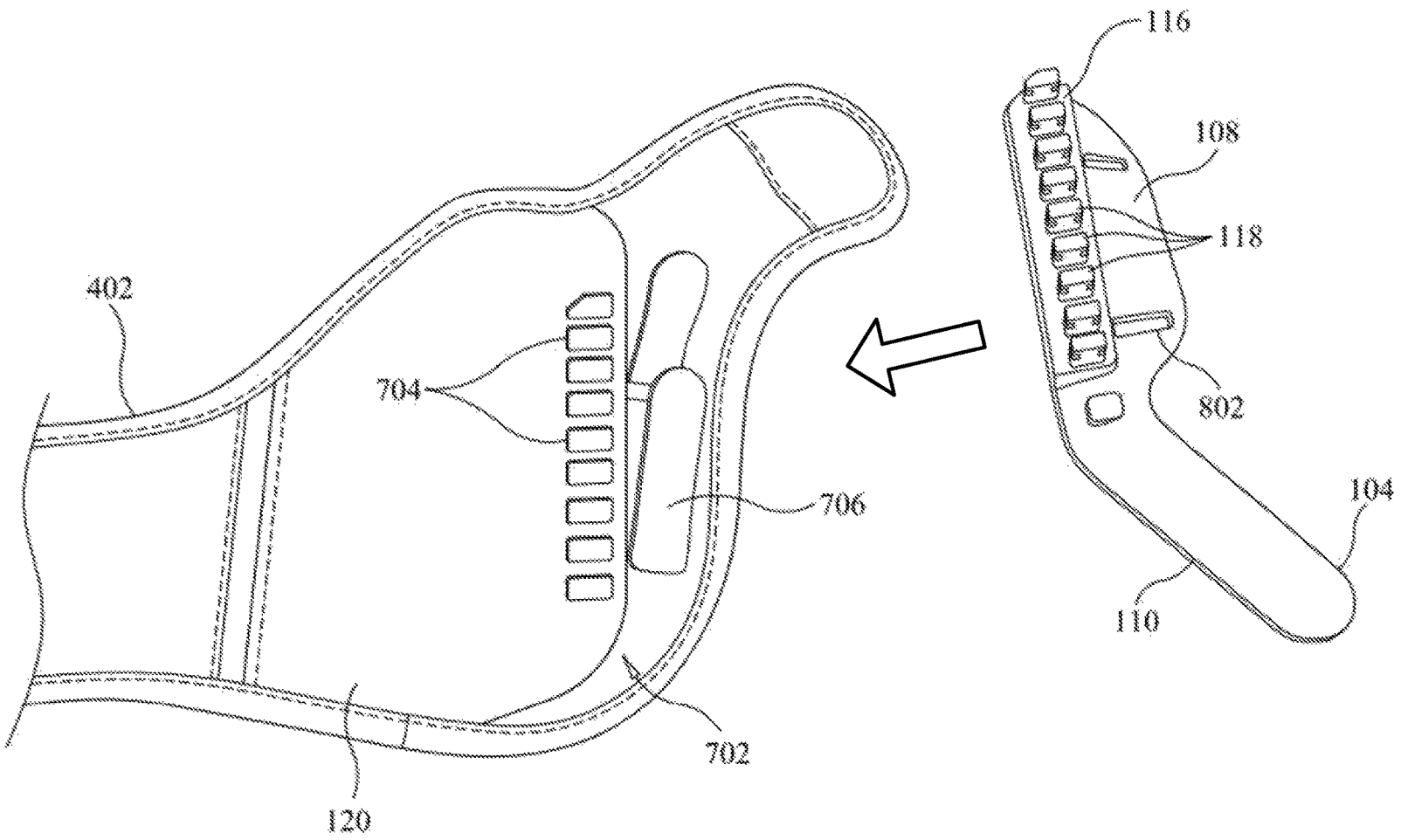
FIG. 8 shows an example upper wrap and an example ankle holster brace, according to an embodiment.
Figure 9:
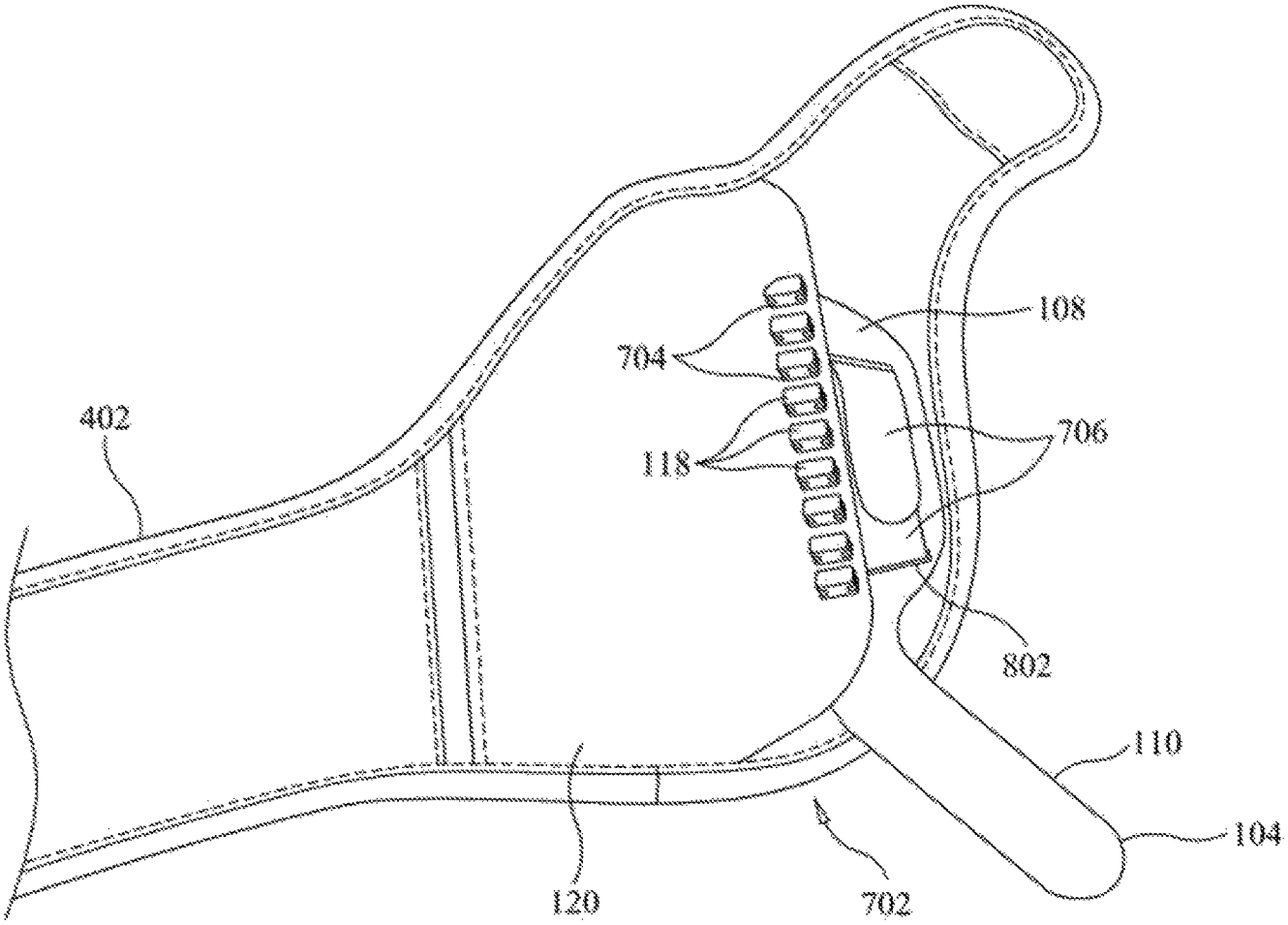
FIG. 9 shows fitting the example ankle holster brace to the example upper wrap, according to an embodiment.

In various embodiments, the upper wrap 402 includes one or more additional features for securing the brace 104 to the upper wrap 402 and/or backer 120. For example, as shown in FIGS. 7-11, the upper wrap 402 may include one or more tabs 706 (or the like) which insert through slots 802 in the brace, and which may be folded over to secure the brace 104 to the upper wrap 402. FIG. 8 shows the brace 104 aligned to be coupled to the upper wrap 402 and FIG. 9 shows the brace 104 in position in the pocket 702 and coupled to the upper wrap 402, with the mounting features 118 through the openings 704 in the backer 120, and the tabs 706 through the slots 802 in the brace 104.

Figure 10B:
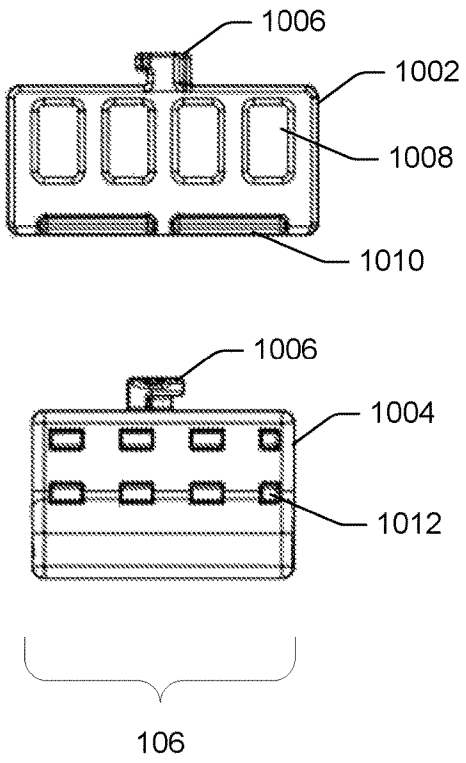
FIGS. 10A and 10B show (A) the example ankle holster brace, and (B) an example connection assembly, according to an embodiment.
Figure 10A:
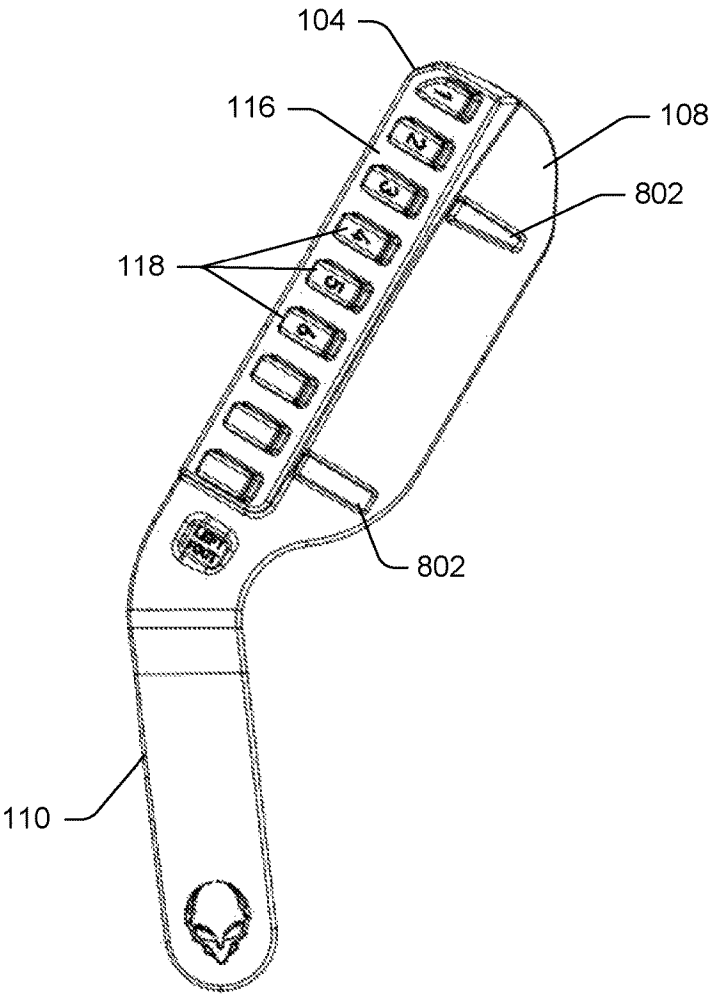

Referring to FIG. 10B, a connector 1002 and a connector lock 1004 make up the connection assembly 106 in the illustrated example. The connector 1002 is placed over the mounting features 118 while the brace 104 is inside the pocket 702 and the mounting features 118 protrude through the openings 704 in the backer 120. The connector 1002 includes openings 1008, which also fit over the mounting features 118. The connector 1002 is placed over the mounting features 118 with the mounting features 118 protruding through openings 1008 selected by the user (see FIG. 11), based on the position desired for the holster shell 102 relative to the brace 104: the connector 1002 can be placed higher on the brace 104 for some implements and placed lower on the brace 104 for other implements, as desired for comfort and performance.

In an implementation, as shown in FIG. 10B, the connector 1002 includes tabs 1010 (or like features) which match slots (or like complementary features) of the holster shell 102. For instance, the connection assembly 106 may be used for holster shells 102 that have latch components or other features to allow coupling the holster shell 102 to objects. In various embodiments, the tabs 1010 are modular connection components found on other modular holster systems and accessories, which are configured to match the slots on the holster shell 102. Accordingly, with the connector 1002 in place on the mounting features 118, the holster shell 102 may be coupled to the backer 120 and brace 104 by placing the slots (not shown) of the holster shell 102 onto the tabs 1010 of the connector 1002.

Figure 11:
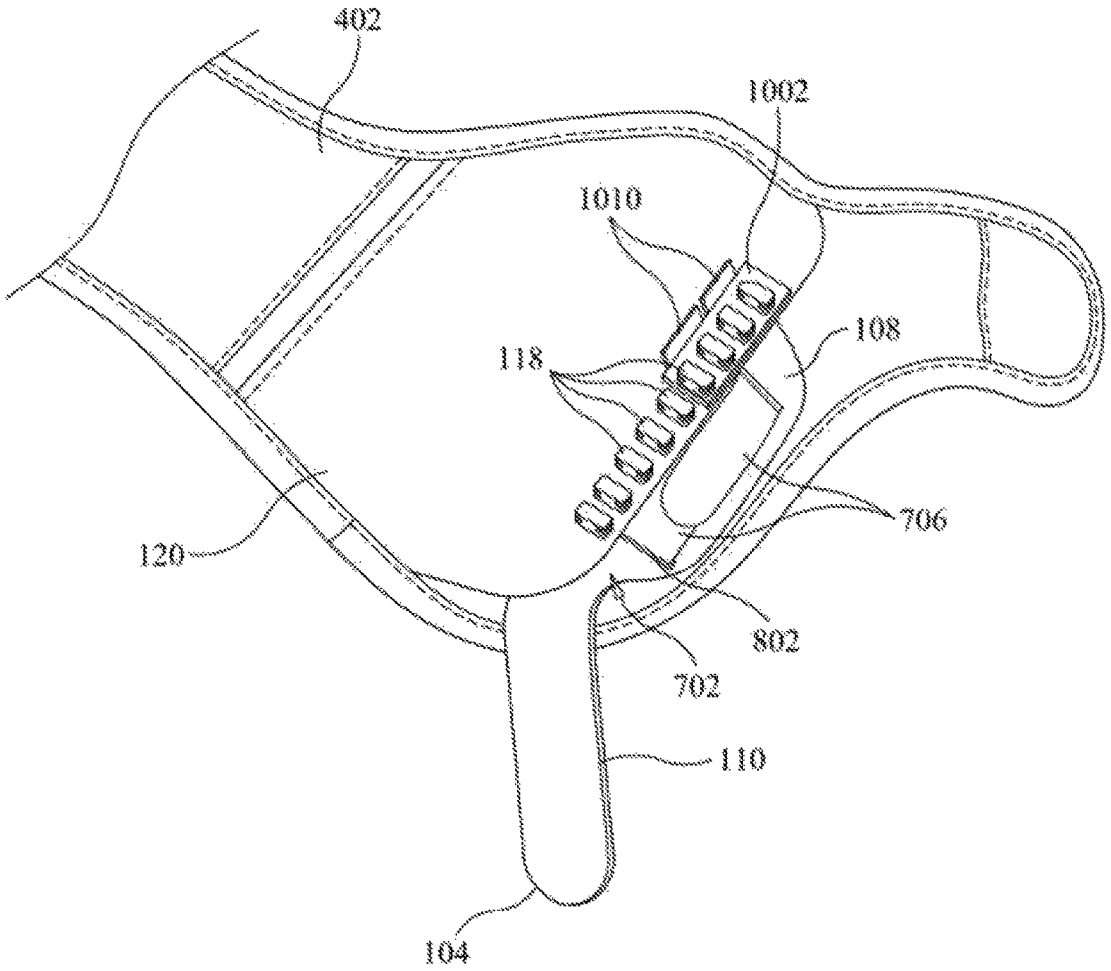
FIG. 11 shows the example ankle holster brace fitted within the example upper wrap, and with the connector installed, according to an embodiment.
Figure 12B:
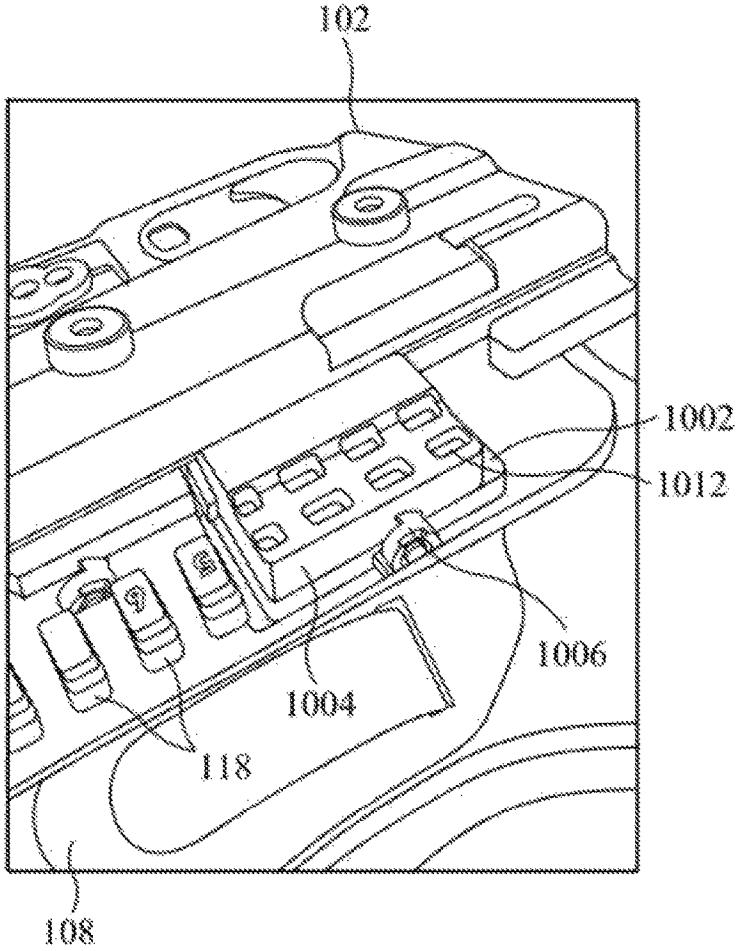
FIGS. 12A and 12B show fitting a holster and the connector lock to the connector on the example ankle holster brace and the example upper wrap, according to an embodiment.
Figure 12A:
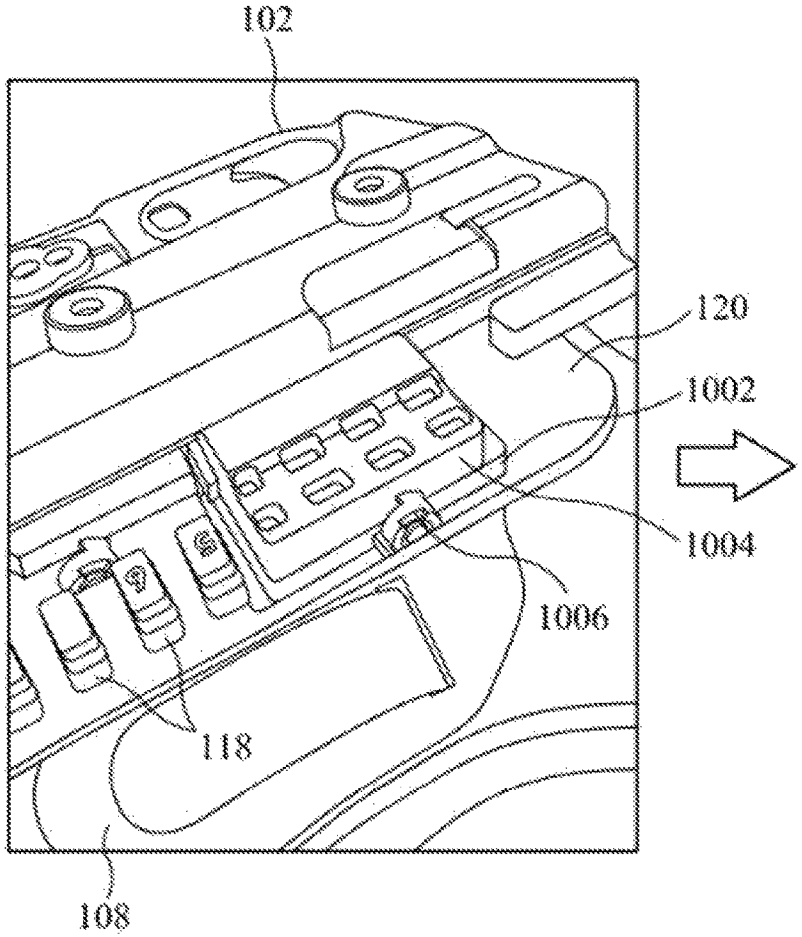
Figure 13:
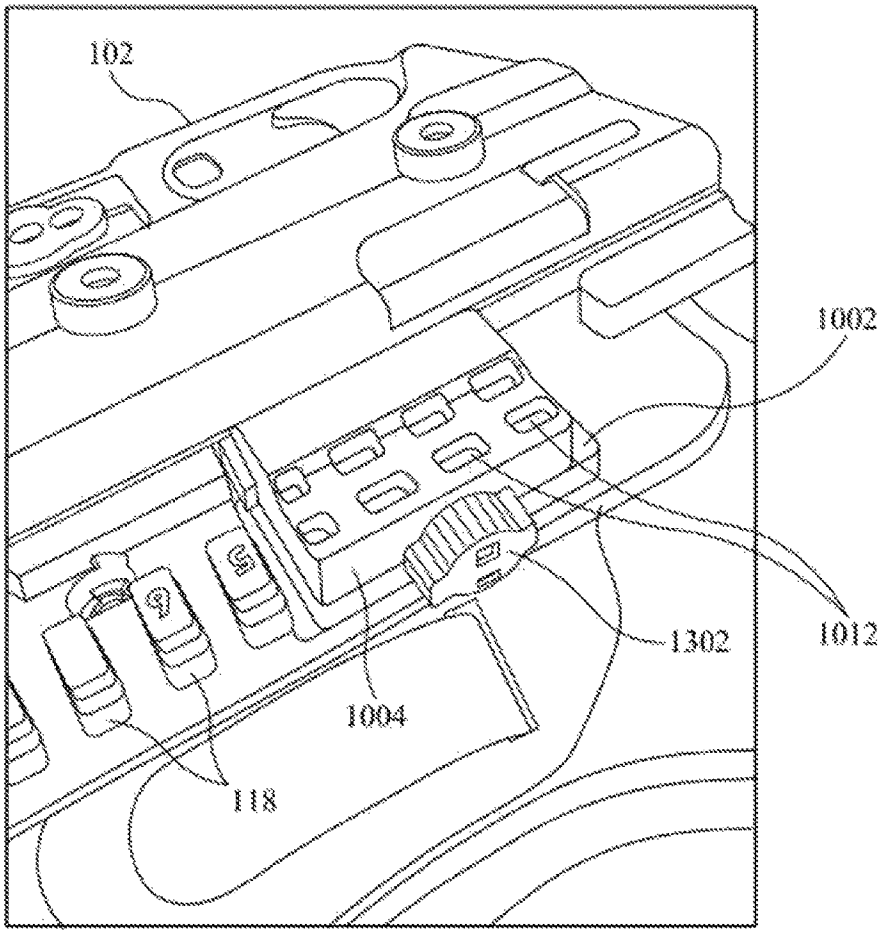
FIG. 13 shows locking the connector lock to the connector.

Referring to FIGS. 12A and 12B, the connector lock 1004 is placed over the connector 1002. In some embodiments, one or more portions 1012 of the connector lock 1004 may engage one or more features of the connector 1002 and/or the mounting features 118, to provide a positive alignment of the connector lock 1004 to the connector 1002. As shown in FIGS. 10B, 11, and 12(A and B), the connector 1002 and the connector lock 1004 may each include a locking feature 1006. When the connector 1002 and the connector lock 1004 are aligned, the locking features 1006 can also be aligned, allowing a locking cap 1302 to be secured on the locking features 1006 (see FIG. 13), preventing the connector 1002 and the connector lock 1004 from separating unintentionally. In other embodiments, other locking mechanisms may also be used to secure the connector 1002 and the connector lock 1004 together.

Figure 14B:
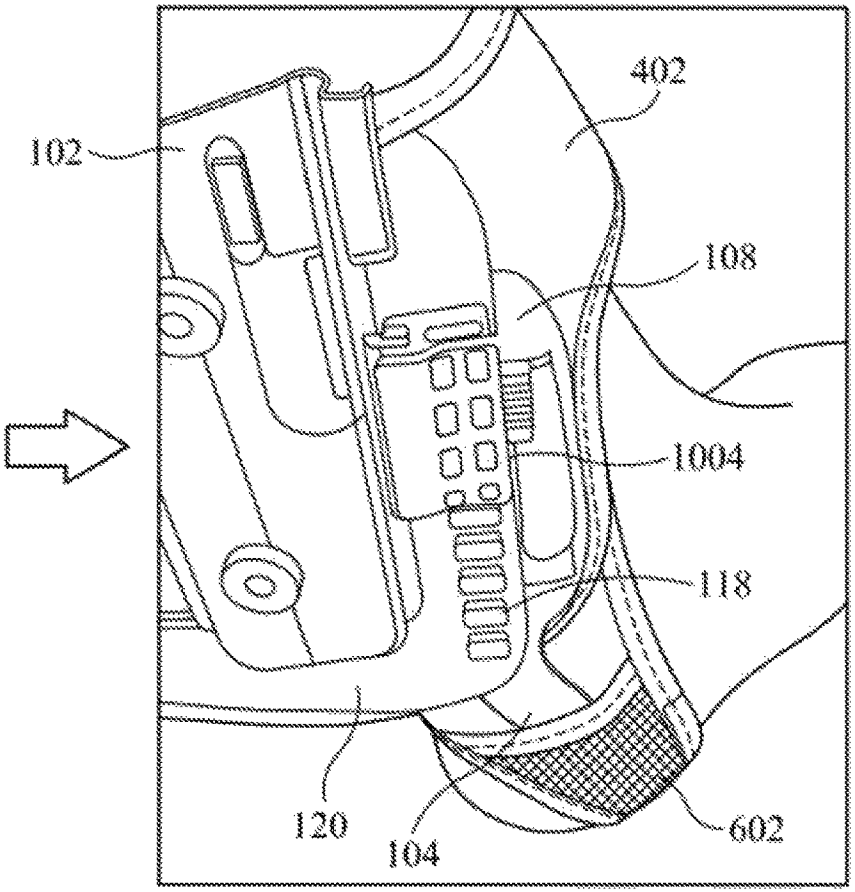
FIGS. 14A and 14B show fitting the assembled upper wrap to the lower wrap, on a user, according to an embodiment.
Figure 14A:
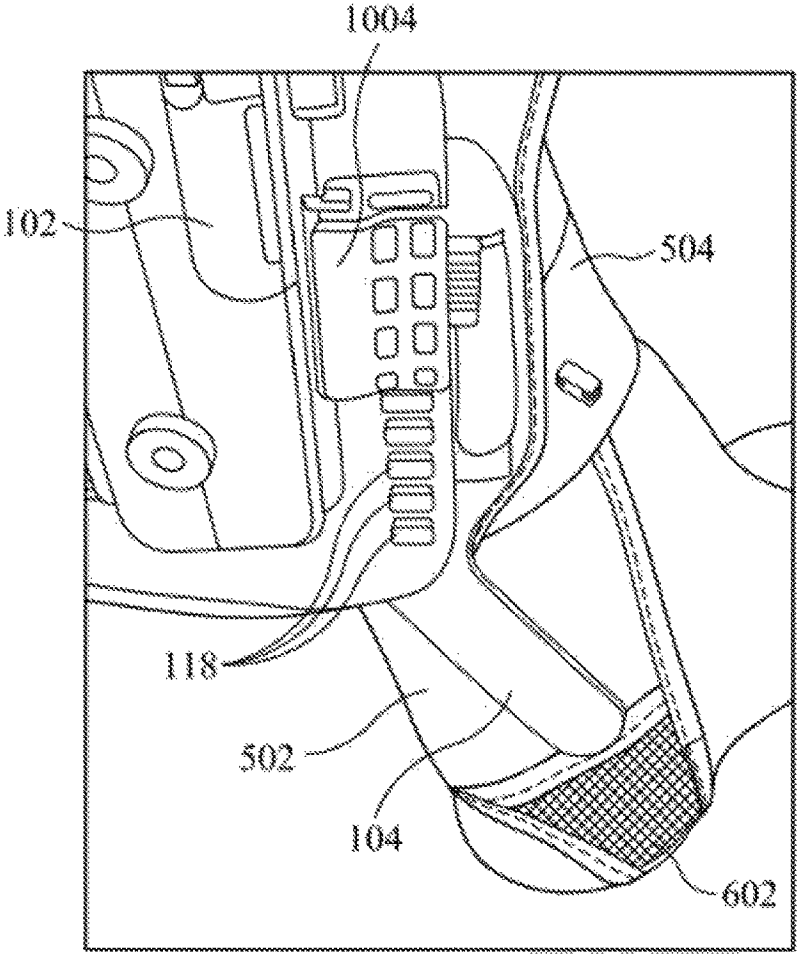
Figure 15:
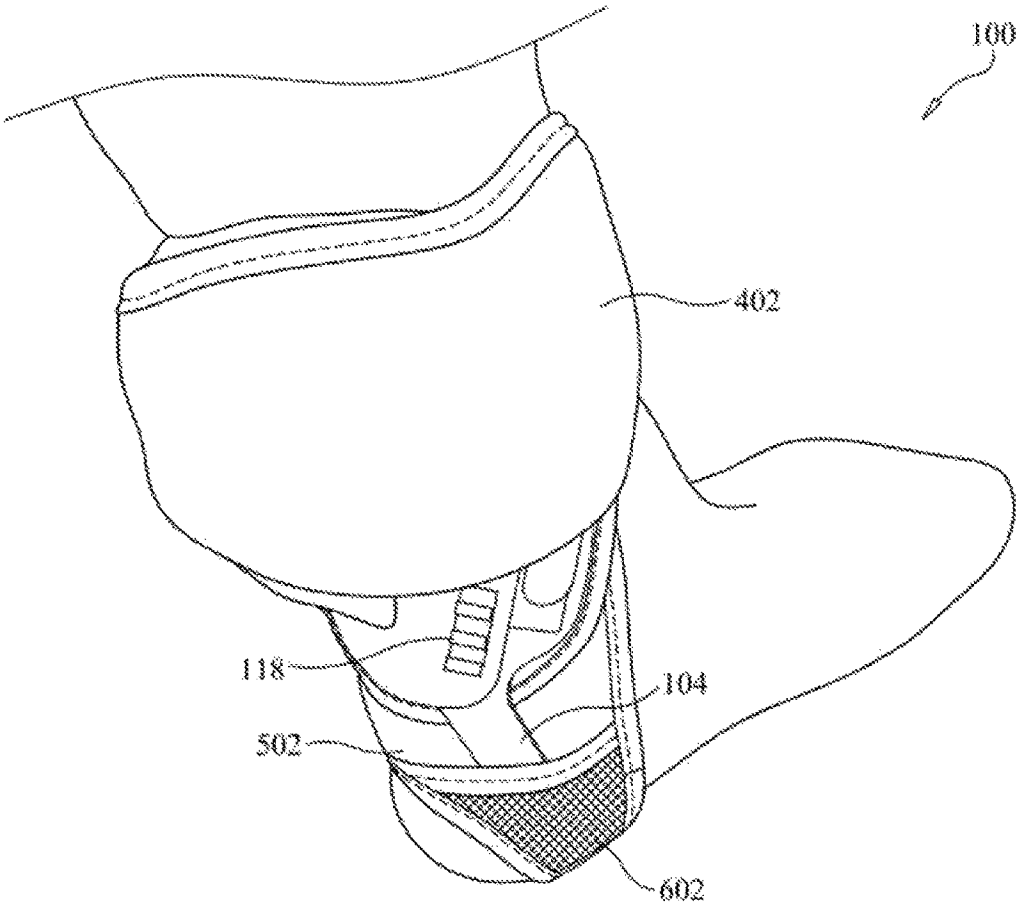
FIG. 15 shows the assembled ankle holster assembly fitted to a user, according to an embodiment.

Once the ankle holster 100 is assembled, it may be placed on the user. Referring back to FIGS. 5A, 5B, and 6, in some implementations, when the lower wrap 502 is used with the ankle holster assembly 100, the lower wrap may be placed on the user first, as shown in FIG. 6. The strap 504 of the lower wrap 502 is used to secure the lower wrap 502 to the user's leg and foot. The lower portion of the lower wrap 502, near the user's foot, includes a brace pocket 602. Referring to FIGS. 14A and 14B, the upper wrap 402 is placed on the user's leg, while depositing the lower free end of the brace 104 into the brace pocket 602 (see FIG. 14B). As well as positioning the upper wrap 402 correctly on the user's leg, this stabilizes the ankle holster assembly 100 on the user's leg, and transfers distributed weight of the implement and holster shell 102 to the user's shoe or the bottom of the user's foot. The upper wrap 402 is then wrapped around the user's lower leg, as shown in FIG. 15. The shape of the upper wrap 402 serves to form a pocket around the holster shell 102, protecting the holster shell 102 and the implement, and concealing the holster shell 102 and implement from easy observation.

The ankle holster assembly 100 is discussed in terms of securing a holster shell 102, but the ankle holster assembly 100 may be used to secure or mount any of various items, where secure mounting on a body of the user are desired. Although various implementations and examples are discussed herein, further implementations and examples may be possible by combining the features and elements of individual implementations and examples.

In various implementations, components of the ankle holster assembly 100 are comprised of various textiles, plastics, composites, metals, combinations of the same, or the like. For example, the upper 402 and lower 502 wraps may be comprised of a heavy duty textile, such as an aramid fabric, a poly blend, a fiber composite blend, or the like. The brace 104 may be comprised of a metal such as aluminum, or a strong plastic or composite. The backer 120 may be comprised of a natural or synthetic leather, a heavy duty textile, a plastic, or the like. The upper wrap 402, lower wrap 502, and the backer 120 may include multiple layers of material, including different materials on one or more of the layers. The layers may also include metal, plastic, fiber, or composite (or the like) inserts for strength and durability, and/or softer, breathable, comfort layers (e.g., neoprene, or the like) nearest to the user.

The holster shell 102 and the connection assembly 106 components may be comprised of a polyamide, or similar material. For example, the holster shell 102 and the connection assembly 106 components may be injection molded, stamped, formed, or the like. In various embodiments, the holster shell 102 and the connection assembly 106 components have rigidity and stability properties based on a particular material selected. For example, some materials that may be used include styrenic block copolymers (TPE-s), polyolefin blends (TPE-o), elastomeric alloys (TPE-v or TPV), thermoplastic polyurethanes (TPU), Thermoplastic copolyesters, thermoplastic polyamides, various metals and alloys, fiber composites, combinations of the same, and the like. Additionally, in some embodiments, the stability properties are also based on a thickness of the holster shell 102 and the connection assembly 106 components. The holster shell 102 may also be comprised of a natural or synthetic leather, a heavy duty textile, a composite, or the like.

In various implementations, the ankle holster assembly 100 may include fewer, more, or alternate components, and remain within the scope of the disclosure. In various embodiments, the shape and configuration of the ankle holster assembly 100 components may vary to accommodate different implements or applications. In an example, the holster shell 102, brace 104, backer 120, and/or upper 402 or lower 502 wraps may be formed to closely fit a particular implement. In other examples, the ankle holster assembly 100 components may be more generally formed to fit multiple implements.

The illustrations of FIGS. 1-15 are not intended to be limiting. In the various example embodiments illustrated in FIGS. 1-15, the location and position of the components, locking mechanisms, and the like are for example only. Other locations and positions are contemplated and are within the scope of this disclosure. In some cases, additional or alternative components, techniques, sequences, or processes may be used to implement the techniques described herein. Further, the components and/or techniques may be arranged and/or combined in various combinations, while resulting in similar or approximately identical results. It is to be understood that an ankle holster assembly 100 may be implemented as a stand-alone device or as part of another system (e.g., integrated with other components). In various implementations, additional or alternative components may be used to accomplish the disclosed techniques and arrangements.

CONCLUSION

Although the implementations of the disclosure have been described in language specific to structural features and/or methodological acts, it is to be understood that the implementations are not necessarily limited to the specific features or acts described. Rather, the specific features and acts are disclosed as representative forms of implementing the claims.

What is claimed is:

1. An implement holster mounting assembly, comprising:

a brace configured to be worn on a lower leg of a person, including:

an attachment arm having a multi-position attachment mount portion adapted to receive an implement or an implement holster, the attachment mount portion including multiple mounting positions for adjusting a carry position of the implement or the implement holster higher or lower on the lower leg of the person, and a plurality of mounting features, a mounting feature disposed at each of the multiple mounting positions; and a support arm coupled to the attachment arm and adapted to support and to distribute a weight of the implement or the implement and the implement holster, at least a portion of the support arm disposed offset from the attachment mount portion;

a backer coupled to the brace and adapted to protect the person from the implement or the implement holster, the backer configured to be wrapped around at least a portion of the leg of the person;

an upper wrap coupled to the backer and separately coupled to the brace via one or more interface fixtures at the upper wrap and at the brace, the upper wrap configured to wrap all the way around the leg of the person to secure the implement holster mounting assembly to the leg of the person; and a brace pocket disposed at a junction of the backer and the upper wrap, the brace pocket configured to receive the brace with the backer disposed over the brace, wherein the backer includes a plurality of openings and the plurality of mounting features of the attachment mount portion protrude through the plurality of openings of the backer while the brace is within the pocket.

2. The holster mounting assembly of claim 1, further comprising an offset arm connecting the attachment arm to the support arm, the offset arm adapted to offset the attachment mount portion from the support arm a predetermined distance to distribute the weight of the implement or the implement and the implement holster on the lower leg of the person.

3. The holster mounting assembly of claim 1, the brace further comprising a lower support portion at an end of the support arm opposite the attachment arm, the lower support portion adapted to be inserted into a shoe of the person and to transfer at least a portion of the weight of the implement or the implement and the implement holster to the shoe.

4. The holster mounting assembly of claim 1, wherein the upper wrap is configured to wrap around the implement or the implement holster, at least partly concealing the implement or the implement holster when the upper wrap is wrapped around the leg of the person.

5. The holster mounting assembly of claim 1, wherein the plurality of mounting features disposed at the attachment mount portion protruding through the plurality of openings of the backer are configured to receive the implement or the implement holster on a subset of the mounting features to determine the carry position of the implement or the implement holster.

6. The holster mounting assembly of claim 5, further comprising a connection assembly removably coupled to the attachment mount portion via one or more of the mounting features, the connection assembly adapted to be disposed over the backer and to overlay one or more of the mounting features protruding through the plurality of openings of the backer to capture a portion of the implement or the implement holster to removably couple the implement or the implement holster to the brace.

7. The holster mounting assembly of claim 6, wherein a ride height of the implement or the implement holster is user-adjustable by removing the connection assembly from the one or more of the mounting features and re-coupling the connection assembly to the attachment mount portion via another one or more of the mounting features.

8. The mounting assembly of claim 1, further comprising a connection assembly configured to mount the implement or the implement holster to the brace, the connection assembly adapted to be disposed partially over the backer and partially over the implement or the implement holster and to overlay one or more of the mounting features protruding through the plurality of openings of the backer to trap the backer between the connection assembly and the attachment mount portion and to capture a portion of the implement or the implement holster between the connection assembly and the attachment mount portion, the connection assembly adapted to be mounted to the attachment mount portion in one or more of a plurality of positions.

9. The mounting assembly of claim 8, wherein the connection assembly includes a connector adapted to engage with one or more mounting features at the attachment mount portion to determine a height of the implement or the implement holster on the leg of the person.

10. The mounting assembly of claim 9, wherein the connector includes one or more mounting tabs configured to receive one or more features of the implement or the implement holster to couple the implement or the implement holster to the brace.

11. The mounting assembly of claim 9, wherein the connection assembly includes a connector lock adapted to fit over the connector and configured to lock the portion of the implement or the implement holster to the connector until intentionally released by the person.

12. The mounting assembly of claim 1, further comprising a lower wrap configured to be worn on the leg of the person, the lower wrap including a pocket configured to receive a free end of the support arm opposite the attachment arm and to restrict movement of the brace and to distribute the weight of the implement or the implement and the implement holster to a foot or a shoe of the person.

13. A holster for an implement, comprising:

a holster shell;

a brace configured to be worn on a lower leg of a person, including:

an attachment arm having a multi-position attachment mount portion adapted to receive the holster shell, the attachment mount portion including multiple mounting features at multiple mounting positions adapted to removably couple the holster shell to the brace and to adjust a carry position of the holster shell; and a support arm coupled to the attachment arm, the support arm adapted to support and to distribute a weight of the implement and the holster shell, at least a portion of the support arm disposed offset from the attachment mount portion; and an offset arm connecting the attachment arm to the support arm, the offset arm adapted to offset the attachment mount portion from the support arm a predetermined distance to distribute the weight of the implement and the holster shell on the lower leg of the person;

a backer portion coupled to the brace and adapted to protect the person from the implement or the holster shell, the backer portion configured to be wrapped around at least a portion of the leg of the person;

an upper wrap coupled to the backer portion and separately coupled to the brace via one or more interface fixtures at the upper wrap and at the brace, the upper wrap configured to wrap all the way around the leg of the person to secure the implement holster mounting assembly to the leg of the person;

a brace pocket disposed at a junction of the backer portion and the upper wrap, the brace pocket configured to receive the brace with the backer portion disposed over the brace, wherein the backer portion includes a plurality of openings and the multiple mounting features of the attachment mount portion protrude through the plurality of openings of the backer portion while the brace is within the pocket; and a connection assembly removably coupled to the attachment mount portion via one or more of the mounting features, the connection assembly being disposed partly over the backer and partly over the holster shell, engaged with a portion of the holster shell, and overlays one or more of the mounting features protruding through the plurality of openings of the backer to capture the portion of the holster shell to removably couple the holster shell to the brace.

14. A holster for an implement, comprising:

a holster shell adapted to enclose a portion of an implement;

a brace configured to be worn on a lower leg of a person, including:

an attachment arm having a multi-position attachment mount portion adapted to receive the holster shell, the attachment mount portion including multiple mounting positions with a mounting feature disposed at each of the multiple mounting positions adapted to removably couple the holster shell to the brace and to adjust a position of the holster shell higher or lower relative to the brace; and a support arm coupled to the attachment arm and adapted to support and to distribute a weight of the implement and the holster shell, at least a portion of the support arm disposed offset from the attachment mount portion;

a backer coupled to the brace and adapted to protect the person from the implement or the holster shell, the backer configured to be wrapped around at least a portion of the leg of the person;

an upper wrap coupled to the backer and separately coupled to the brace via one or more tabs at the upper wrap and one or more slots at the brace and configured to wrap all the way around the leg of the person, the upper wrap configured to wrap around the implement and the holster shell, at least partly concealing the implement and the holster shell when the upper wrap is wrapped around the leg of the person; and a brace pocket disposed at a junction of the backer and the upper wrap, the brace pocket configured to enclose a portion of the brace within the brace pocket with the backer disposed over the portion of the brace, wherein the backer includes a plurality of openings and the plurality of mounting features of the attachment mount portion protrude through the plurality of openings of the backer while the portion of the brace is within the pocket.

15. The holster of claim 14, further comprising a lower wrap configured to be worn on the ankle of the person, the lower wrap including a pocket configured to receive a free end of the support arm opposite the attachment arm, to restrict movement of the brace, and to distribute the weight of the implement and the holster shell to a foot or a shoe of the person.

16. The holster of claim 14, further comprising a connection assembly configured to mount the holster shell to the brace, the connection assembly adapted to capture a portion of the holster shell and adapted to be mounted to the attachment mount portion in one or more of a plurality of positions.

* * * * *